US007928711B2

(12) United States Patent
Augustyniak

(10) Patent No.: US 7,928,711 B2
(45) Date of Patent: Apr. 19, 2011

(54) LINEAR VOLTAGE REGULATOR WITH ACCURATE OPEN LOAD DETECTION

(75) Inventor: Marcin K. Augustyniak, Regensburg (DE)

(73) Assignee: Texas Instruments Deutschland GmbH, Freising (DE)

( * ) Notice: Subject to any disclaimer, the term of this patent is extended or adjusted under 35 U.S.C. 154(b) by 120 days.

(21) Appl. No.: 12/405,803

(22) Filed: Mar. 17, 2009

(65) Prior Publication Data

US 2009/0322292 A1 Dec. 31, 2009

(30) Foreign Application Priority Data

Dec. 11, 2007 (DE) ..... 10 2007 059 498

(51) Int. Cl.
*G05F 1/00* (2006.01)

(52) U.S. Cl. ..... 323/281; 323/280; 323/277

(58) Field of Classification Search ..... 323/224, 323/281, 280, 277
See application file for complete search history.

(56) References Cited

U.S. PATENT DOCUMENTS 4,465,967 A * 8/1984 Tokunaga et al. ..... 323/285
5,079,456 A 1/1992 Kotowski et al.
5,623,224 A * 4/1997 Yamada et al. ..... 327/333
6,160,360 A 12/2000 Davis
7,589,507 B2 * 9/2009 Mandal ..... 323/273

FOREIGN PATENT DOCUMENTS

DE 10129550 A1 1/2003
EP 0280514 A1 2/1988

OTHER PUBLICATIONS

Office action issued by Deutsches Patent-und Markenarnt, dated Apr. 30, 2009, regarding German application No. 10 2007 059 498.6-32.

* cited by examiner

*Primary Examiner* — Shawn Riley
(74) *Attorney, Agent, or Firm* — William B. Kempler; Wade J. Brady, III; Frederick J. Telecky, Jr.

(57) ABSTRACT

A linear voltage regulator is provided which has a pair of complementary power transistors connected "back to back" in series between a voltage input and a voltage output. A current sense circuit including a current sense resistor is connected in parallel across one of the power transistors, such as the one connected to the voltage input. As long as the voltage drop in the current sense circuit remains small, i.e. less than app. 0.7V, the current flowing through the bulk diode of the power transistor remains negligible and the entire output current flows through the current sense circuit. For higher output currents the voltage drop across the current sense circuit is limited by the parallel bulk diode of the power transistor. The current sense resistor can be dimensioned to generate a relatively high voltage drop of e.g. 100 mV, and a high accuracy of open load detection is achieved without the requirement for a high precision comparator.

8 Claims, 1 Drawing Sheet

LINEAR VOLTAGE REGULATOR WITH ACCURATE OPEN LOAD DETECTION

FIELD OF THE INVENTION

The present invention relates to a linear voltage regulator with accurate load detection.

BACKGROUND OF THE INVENTION

In some applications of linear voltage regulators it is a requirement to detect an open load condition on the voltage output of the regulator. The open load condition is defined as a condition where the output current is less than a predetermined minimum current. The output current can be measured by including a current sense resistor in the regulator's output path. However, since the minimum output current defined as corresponding to an open load condition is usually much smaller than a typical or maximum load current, the voltage drop across the current sense resistor must be very small, and detection of the open load condition is either not accurate or requires the use of high precision comparators.

A possible approach is to place a current sense resistor in a separate current sense path connected across the regulator's power transistor. The current sense path would include a replication of the power transistor. In such a configuration, the current sense resistor can be dimensioned irrespective of the maximum output current of the regulator so as to provide a much larger voltage drop at the minimum output current defined as the open load current. This approach, however, is still not satisfactory because the overall accuracy is affected by a possible mismatch between the thresholds of the power transistor and its replication.

SUMMARY OF THE INVENTION

One aspect of the present invention provides a linear voltage regulator which achieves high accuracy in open load detection without the requirement for a high precision comparator. Specifically, one aspect of the invention provides a linear voltage regulator with a pair of complementary power transistors connected "back to back" in series between a voltage input and a voltage output. A current sense circuit is connected in parallel across one of the power transistors, such as the one connected to the voltage input. The current sense circuit includes a current sense resistor. A reference current path has a reference resistor connected in series with a current sink between the voltage input and a reference terminal, usually ground. A comparator has a first input connected to a terminal of the current sense resistor and a second input connected to a node between the reference resistor and the current sink. The comparator compares the voltage drop across the current sense resistor with the constant voltage drop across the reference resistor and provides an output signal indicative of an open load condition when the voltage drop across the current sensor falls below that of across the reference resistor. As long as the voltage drop in the current sense circuit remains small, i.e. less than app. 0.7V, the current flowing through the bulk diode of the power transistor remains negligible and the entire output current flows through the current sense circuit. For higher output currents the voltage drop across the current sense circuit is limited by the parallel bulk diode of the power transistor. With this approach, the current sense resistor can be dimensioned to generate a relatively high voltage drop of e.g. 100 mV, and a high accuracy of open load detection is achieved without the requirement for a high precision comparator.

In one embodiment, the current sense circuit includes a normally ON transistor connected in series with the current sense resistor and controlled to an OFF condition when an excessive voltage is detected at the voltage output thereby providing protection against reverse current due to a short circuit to battery voltage.

BRIEF DESCRIPTION OF THE DRAWINGS

Further details of the invention will appear from the following description with reference to the appending drawings. In the drawings.

DETAILED DESCRIPTION OF THE EXAMPLE EMBODIMENTS

Figure 1:
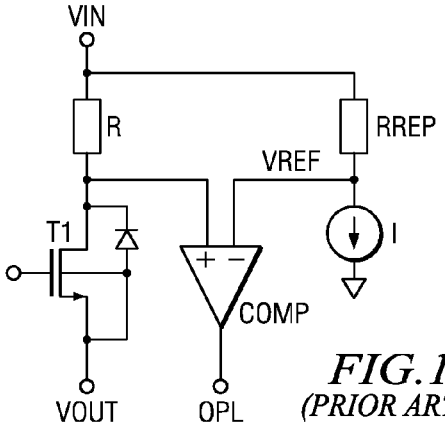
FIG.1 (PRIOR ART)
FIG. 1 is a schematic circuit diagram of a conventional linear voltage regulator with open load detection.

In FIG. 1, a power transistor T1 of a linear voltage regulator is connected in series with a current sense resistor R between a voltage input VIN and a voltage output VOUT. A reference circuit with a reference resistor Rrep in series with a current sink is connected between voltage input VIN and ground. A comparator COMP has an inverting input connected to the node between the reference resistor Rrep and the current sink I and a non-inverting input connected to the node between current sense resistor R and transistor T1. The comparator COMP compares the voltage drop across current sense resistor R with that across the reference resistor Rrep and provides an output signal OPL indicative of an open load condition whenever the voltage drop across current sensor resistor R falls below that across reference resistor Rrep. Since the entire load current flows through current sense resistor R and the minimum load current defined as an open load condition is typically very small compared to the maximum load current, the current sense resistor must have a small value and the voltage drop across the current sense resistor in an open load condition will be very small. Accordingly, for high accuracy of open load detection, a high precision comparator COMP is required.

Figure 2:
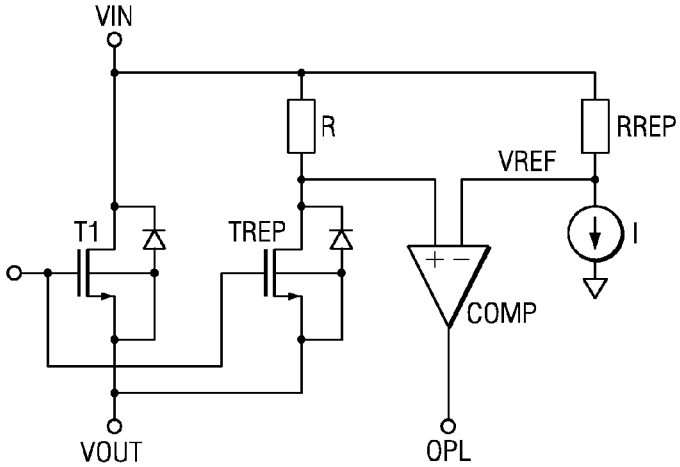
FIG. 2 is a schematic circuit diagram of a linear voltage regulator with an improved open load detection circuit.
Figure 3:
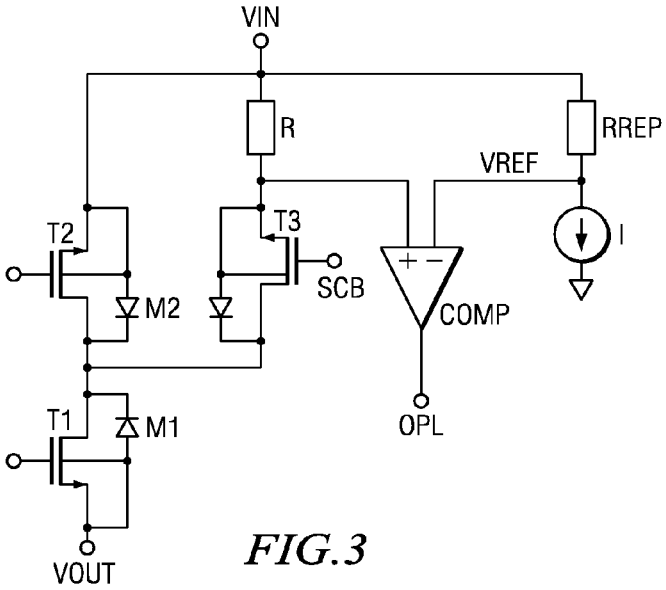
FIG. 3 is a schematic circuit diagram of a linear voltage regulator with the inventive open load detection circuit.

With the approach in FIG. 2, a separate current sense circuit is provided which consists of a current sense resistor R and a replicated transistor Trep, connected in parallel across the power transistor TI. Since only a fraction of the load current flows through the current sense circuit, the value of the current sense resistor can be much higher, providing a correspondingly higher voltage drop in an open load condition which is easily handled by an ordinary comparator. However, due to a possible mismatch in threshold voltage between power transistor T1 and its replication Trep, the accuracy of open load detection is still problematic.

In the inventive linear voltage regulator, a pair of complementary power transistors T1 and T2 are connected "back to back" between the voltage input VIN and voltage output VOUT. Each transistor T1, T2 has its associated bulk diode M1, M2 reverse-connected across source and drain. A current sense circuit in including a current sense resistor R in series with a transistor T3 is connected across drain and source of transistor T2. In the non-limiting embodiment shown, transistors T2 and T3 are of like p-channel type whereas transistor T1 is of n-channel type. The open load detection circuit part with the reference current path (Rrep, I) and comparator (COMP) is similar to that in FIG. 2.

In operation of the inventive linear voltage regulator, transistor T3 is normally ON by virtue of a control signal SCB applied to its gate. The entire load current flows through the current sense resistor R and transistor T3 as long as the voltage drop across both remains below app. 0.7V and current flow through diode M2 remains negligible. For higher load currents the voltage drop across the current sense circuit is limited by diode M2.

The purpose of transistor T3 is to block any reverse current when an excessive voltage is detected at terminal VOUT due e.g. to a short circuit to battery voltage. In that case the gate control signal SCB controls transistor T3 to the OFF condition.

It is easily seen that current sensor R can be dimensioned to provide a relatively high voltage drop at open load, say about 100 mV, just as with the approach in FIG. 2, but the problem with transistor mismatch is avoided. Accordingly, a high accuracy of open load detection is achieved with a normal comparator.

While the invention has been shown and described with reference to preferred embodiments thereof, it is well understood by those skilled in the art that various changes and modifications can be made in the invention without departing from the spirit and scope of the invention as defined by the appended claims.

What is claimed is:

1. A linear voltage regulator comprising:

a pair of complementary power transistors connected in series between a voltage input and a voltage output;

a DC current sense circuit connected in parallel across one of said power transistors, said current sense circuit including a current sense resistor;

a DC reference current path with a reference resistor connected in series with a current sink between the voltage input and a reference terminal;

a comparator with a first input connected to a terminal of the current sense resistor and with a second input connected to a node between the reference resistor and the current sink; and wherein the comparator has an output providing a signal indicative or not of an open load condition.

2. The linear voltage regulator according to claim 1, wherein said one power transistor is a p-channel MOS transistor with a bulk diode connected across its source and drain terminals.

3. The linear voltage regulator according to claim 2, wherein the current sense resistor is dimensioned to generate a predetermined voltage drop across the sense circuit at a current flow through the sense circuit which is defined as open load current.

4. The linear voltage regulator according to claim 3, wherein the predetermined voltage drop is substantially 100 mV.

5. The linear voltage regulator according to claim 1, wherein the current sense circuit includes a normally ON transistor connected in series with the current sense resistor and controlled to an OFF condition when an excessive voltage is detected at the voltage output.

6. The linear voltage regulator according to claim 2, wherein the current sense circuit includes a normally ON transistor connected in series with the current sense resistor and controlled to an OFF condition when an excessive voltage is detected at the voltage output.

7. The linear voltage regulator according to claim 3, wherein the current sense circuit includes a normally ON transistor connected in series with the current sense resistor and controlled to an OFF condition when an excessive voltage is detected at the voltage output.

8. The linear voltage regulator according to claim 4, wherein the current sense circuit includes a normally ON transistor connected in series with the current sense resistor and controlled to an OFF condition when an excessive voltage is detected at the voltage output.

* * * * *